United States Patent [19]

Riker

[11] Patent Number: 4,795,264

[45] Date of Patent: Jan. 3, 1989

[54] ARRANGEMENT FOR CONCRETE PRODUCTION IN TUNNELS

[75] Inventor: Rudolf Riker, Memmingen, Fed. Rep. of Germany

[73] Assignee: Messrs. Stetter GmbH, Memmingen, Fed. Rep. of Germany

[21] Appl. No.: 121,627

[22] Filed: Nov. 17, 1987

[30] Foreign Application Priority Data

Nov. 29, 1986 [DE] Fed. Rep. of Germany ..... 3640916

[51] Int. Cl.[4] ..... B28C 7/04

[52] U.S. Cl. ..... 366/18; 366/26; 366/28; 366/34; 366/35; 366/38; 366/40; 366/141; 366/156; 414/339; 414/526; 414/528; 414/502; 198/543; 198/547

[58] Field of Search ..... 366/1, 2, 6, 16–18, 366/26–28, 30, 33–35, 38, 40, 141, 150, 154, 156; 414/326, 327, 339, 340, 502, 526, 528; 198/543, 547, 548, 608, 611

[56] References Cited

U.S. PATENT DOCUMENTS

| | | | |
|---|---|---|---|
| 1,075,350 | 10/1913 | Garretty | 198/543 X |
| 1,995,458 | 3/1935 | McCrery | 366/16 X |
| 2,028,745 | 1/1936 | Hendrick et al. | 366/30 X |
| 2,508,633 | 5/1950 | Zicovich | 366/26 |
| 2,660,034 | 11/1953 | Kemper | 414/339 X |
| 2,748,990 | 6/1956 | Kemper | 366/40 X |
| 3,064,832 | 11/1962 | Heltzel | 198/547 X |
| 3,317,194 | 5/1967 | Heltzel | 366/27 |
| 3,526,392 | 9/1970 | Buelow | 366/6 |
| 3,612,490 | 10/1971 | Bopp | 366/18 |

*Primary Examiner*—Harvey C. Hornsby
*Assistant Examiner*—Stephen F. Gerrity
*Attorney, Agent, or Firm*—Angelo Notaro

[57] ABSTRACT

A concreting train consists of a plurality of wagons supporting a mixer, a multiple conveyor arrangement and separate containers for cement and aggregate. A container for cement has at least one integrated conveyor worm. All container wagons are provided with inclined conveyor belts which extend below the containers and overlap one another. On separate pathes aggregate and cement are supplied into a housing of the mixer wagon. The housing is supported on a weighing frame in order to additively weigh the mixing components. The housing contains a mixing shaft operatively connected with a drive motor. The housing is mounted for reciprocating movement along an inclined angled track in order to lift the housing on a higher level for discharging the concrete into a hopper of a concrete pump. The concreting train is adopted to be used in narrow tunnels in order to provide a multiplicity of small batches of high quality concrete in very short periods of time at the face, whereby quality and consistence can be quickly varied.

15 Claims, 5 Drawing Sheets

Fig. 8
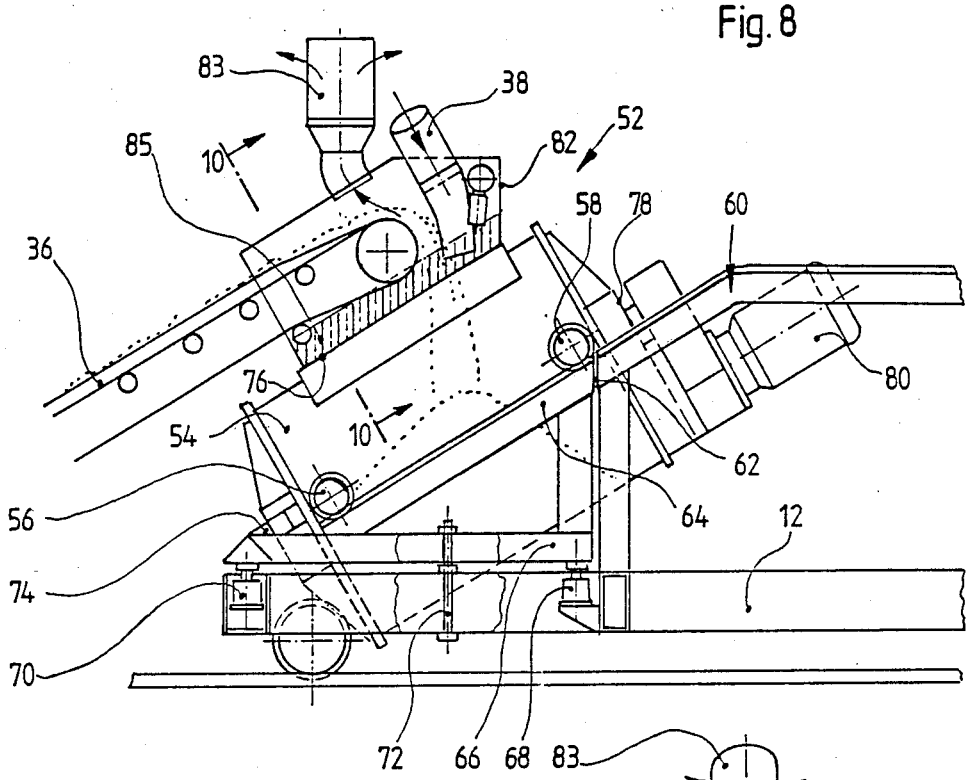
Fig. 9
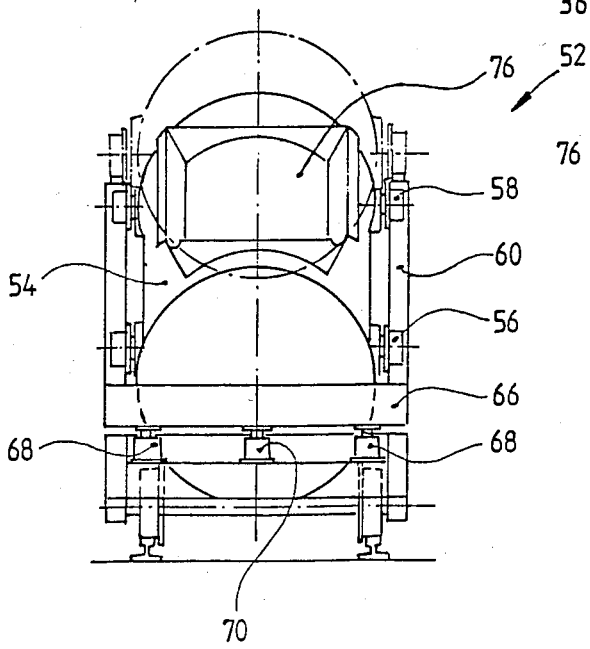
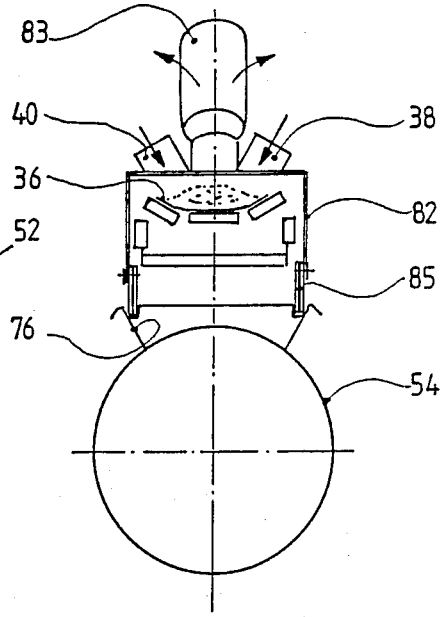
Fig.10

Fig.11
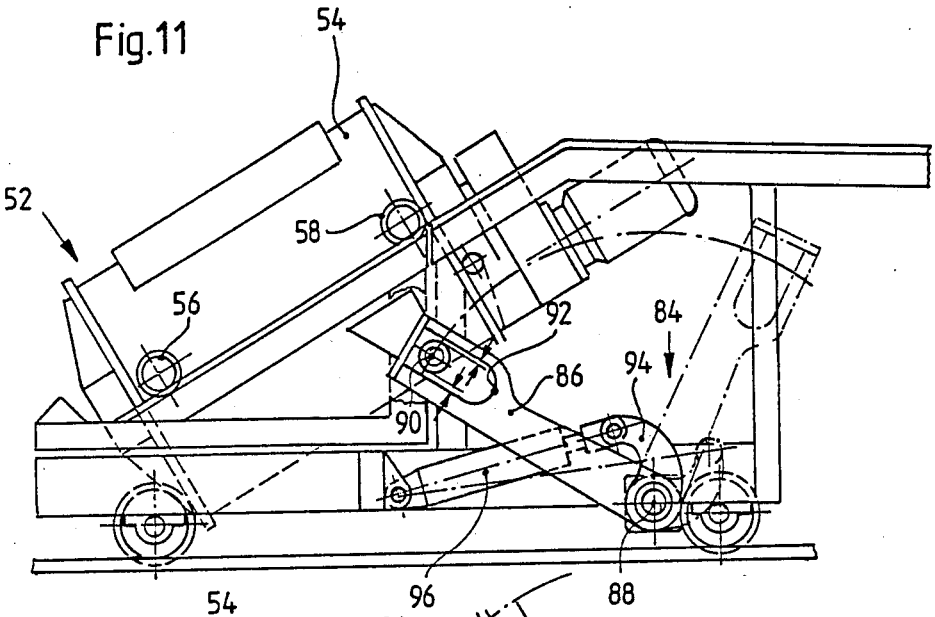
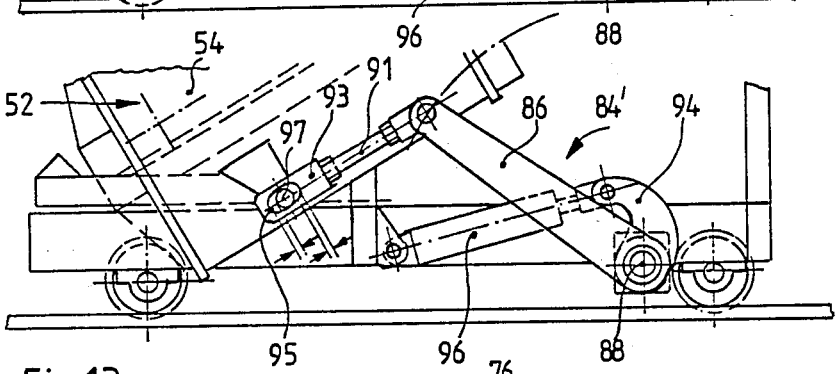
Fig.13
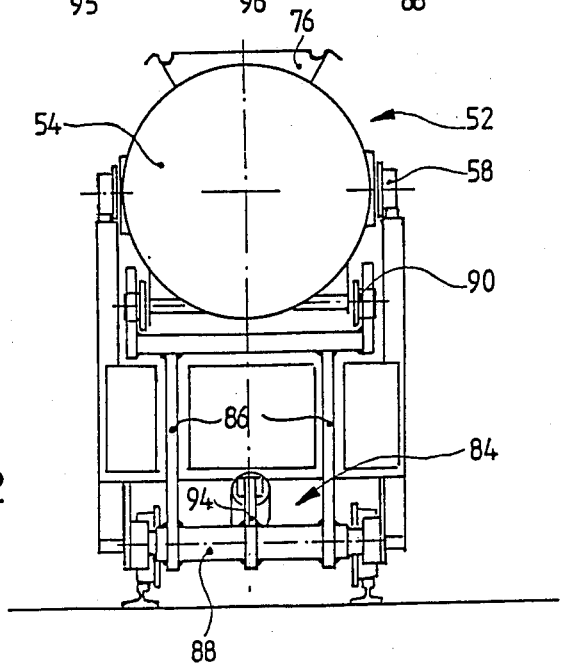
Fig.12

ARRANGEMENT FOR CONCRETE PRODUCTION IN TUNNELS

BACKGROUND OF THE INVENTION

U.S. Pat. No. 1,075,350 describes an apparatus for mixing and depositing concrete. A supply train consists of a plurality of wagons containing sand, aggregate and cement. At both sides of the train belt conveyors are arranged end to end in overlapping relation. The mixing materials, i.e. aggregate, cement etc. fall by gravity through side outlets onto the conveyors and are conveyed theron into side hoppers of a leading wagon. From here the materials are elevated by side elevators and fall in bunkers from which they are metered by rotary measures into a mixer. Water is added and a continuous stream of concrete is produced and leaves the apparatus along an inclined belt conveyor at the front of the train. This apparatus indeed can be used to concrete overground surfaces, however, because of the side conveyors and the elevators its dimensions, i.e. width and height are too great to use it in tunnels. Further, the plurality of measuring devices are expensive if high precision is required.

The periodical "Tunnels and Tunnelling, March, 1986" describes a method for the production of concrete within a tunnel. A rail mounted concreting train comprises a wagon provided with three silos one behind another. The first silo contains two equal weighed batches of cement and the other two silos contain one weighed batch of aggregate respectively. The three silos are weigh-batched outside the tunnel. After both batches have been separately used, the wagon must be taken out of the tunnel for reloading and replaced by the next full one. Cement and aggregate at the same time fall on a belt conveyor below the silos and are conveyed forwards and via a further steep conveyor into a mixer where a defined quantity of water is added. A main disadvantage of this proposal resides in that the batches must be weighed outside the tunnel. The two batches result in 4 $m^3$ concrete. Thereafter the supply wagon must be returned to the supply station outside the tunnel before the next full one can be run in. In the case of long tunnels the lost time is too great. Further the proportion of the mixing components cannot be adapted onto the momentary requirements. The large batches require a corresponding large mixer. Large volume mixers again require longer mixing periods. The common transport of cement and aggregate on the bottom conveyor and steep conveyor results in a remarkable cement loss, because the down-falling cement cannot be completely collected on the bottom conveyor belt. Also a cement dust generation cannot be avoided.

SUMMARY OF THE INVENTION

One main object of the invention is to provide a method to produce concrete of high quality also in long tunnels economically.

One further object of the invention is to provide a method for producing concrete in tunnels using small batches which can be prepared in very short periods of time.

One further object of the invention is to provide a concreting method which allows to quickly change the mixing proportion of the mixing components at the face.

Another object of the invention is to provide a method for preparing concrete in tunnels either using a dry pre-mix of cement and aggregate or using separate supplies of cement and aggregate.

Still another object of the invention is to provide a concreting method which reduces the conveying distances of the mixing components and which avoids cement losses during transport from the supply wagons to the mixer.

One further object of the invention is to provide a concreting train running on rails in a tunnel and allowing a theoretically unlimited supply of mixing components to produce concrete over a long period of time without requiring replacement of supply wagons.

A further object of the invention is to provide a concrete mixer, which also is used as the one and only weighing compartment and as lifting means to bring concrete on a higher level for subsequent use.

BRIEF DESCRIPTION OF THE DRAWINGS

FIG. 8 shows a side view of a mixer in its lowered position in greater detail;

FIG. 9 shows a rearward end view of the mixer shown in FIG. 8;

FIG. 10 shows a detail view in the direction of line 8—8 of FIG. 8;

FIG. 11 shows a side view of the drive unit of the mixer according to FIG. 8;

FIG. 12 shows a rearward end view of the drive unit according to FIG. 11; and FIG. 13 shows a side view of a modified drive unit.

DESCRIPTION OF THE PREFERRED EMBODIMENTS

Figures 1, 2, 3, 4:
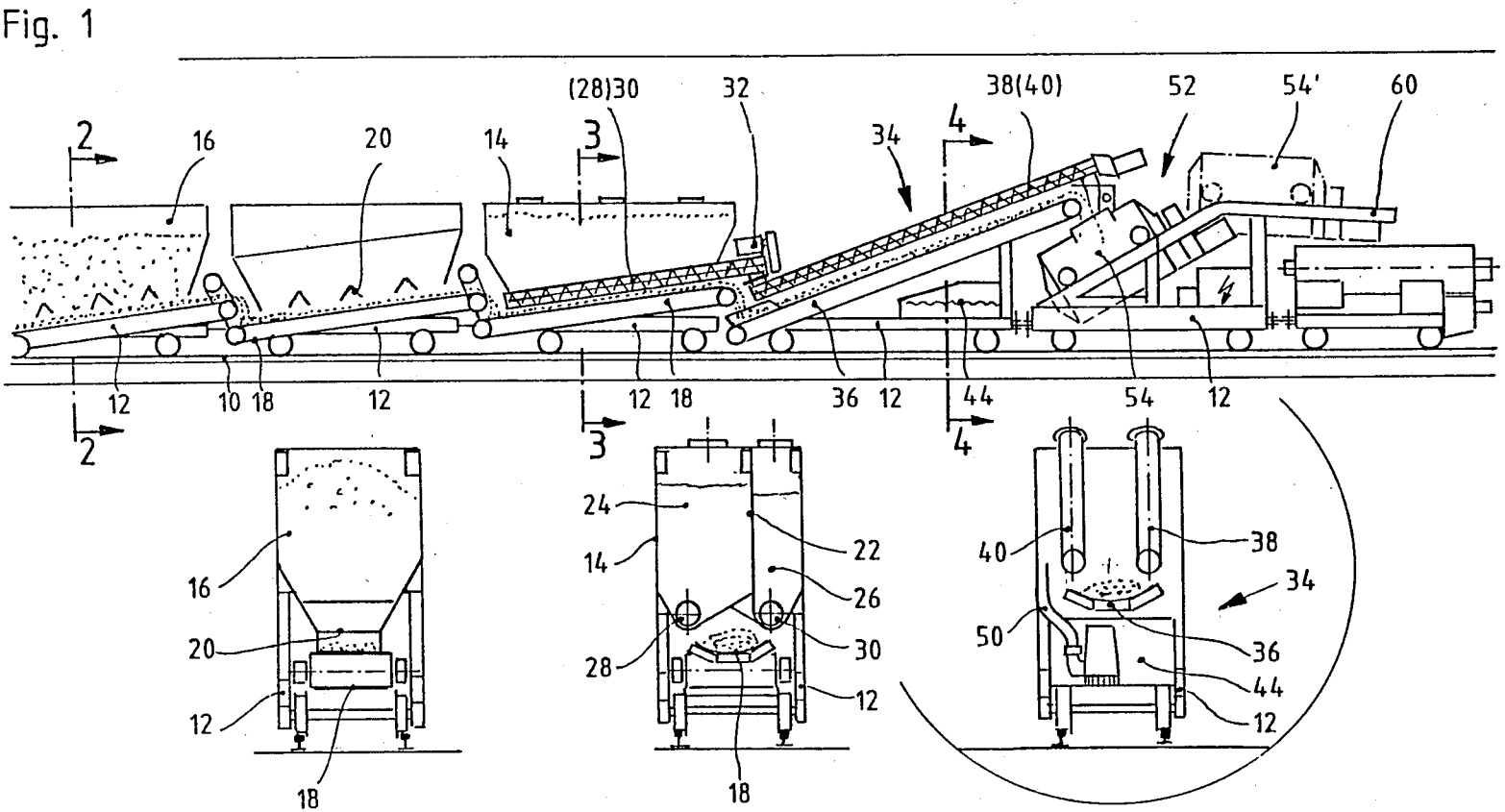
FIG. 1 shows a schematic view of a tunnel concreting train.
FIG. 2 shows a cross-sectional view taken along line 2—2 of FIG. 1.
FIG. 3 shows a cross-sectional view taken along line 3—3 of FIG. 1.
FIG. 4 shows a cross-sectional view taken along line 4—4 of FIG. 1.

A plurality of wagons 12 running on tunnel rails 10 are coupled and form a train. The leading wagon 12 carries a mixer 52. On the next wagon 12 a multiple conveyor arrangement 34 is mounted. The trailing part of the train consists of a plurality of wagons 12 carrying a leading container 14 filled with binding agents and trailing containers 16 respectively containing aggregate as sand and gravel. Below each one of the containers 14, 16 an endless conveyor belt 18 is mounted on the respective wagon 12. The conveyor belt 18 extends over the whole length of the wagon 12, projects forwardly therefrom and is inclined, so that each trailing conveyor belt 18 overlaps an adjacent leading belt 18. Each aggregate container 16 has unclosable bottom openings 20 between of a pair of side walls extending down to the conveyor belt 18. Discharge of the container 16 is controlled exclusively by the conveyor belt 18. At the beginning only the conveyor belt 18 of the leading aggregate container 16 operates. If this container 16 is empty the conveyor belt 18 of the next trailing container is started in addition and transports aggregate onto the belt 18 of the adjacent leading container 16.

The cement container 14 has a longitudinal vertical partition wall 22 which divides the container 14 in two compartments 24, 26 of different volume. The larger compartement 24 is filled with cement and the smaller one 26 contains an auxiliary binding agent as powdered mineral. Each compartment 24, 26 has an inclined trough shaped bottom above which a conveyor worm 28 (30) is rotatably mounted. Both conveyor worms 28, 30 are arranged side by side and extend parallel with the conveyor belt 18 which is spaced below the bottom of container 14. The aggregate, therefore, is transported forwards on the conveyor belt 18 of the cement, container wagon 12 below the cement container 14. Both conveyor worms 28, 30 project from the front wall of container 14. The projecting portions of the worms 28, 30 are enclosed by tubes closed at the front ends and provided with downward extending discharge pieces. Motors 32 are drivingly connected with the conveyor worms 28, 30 respectively.

The multiple conveyor arrangement 34 mounted on its own wagon 12 comprises a steeply ascending belt conveyor 36 having a concave cross-section in its upper run substantially similar with that of belt 18. A pair of worm conveyors 38, 40 are spaced side by side with one another and extend substantially parallel with the belt conveyor 36 and there above. The discharge pieces of the conveyor worms 28,30 are tightly connected with inlet openings of the steep worm conveyors 38, 40 by couplings 42 respectively. The aggregate conveyor belt 18 of the cement container wagon 12 discharges directly onto the steep belt conveyor 36.

Below the multiple conveyor arrangement a water supply tank 44 is arranged on the wagon 12. The tank 44 is connected to a remote water system by a flexible tube 46. A pump 48 supplies mixing water from the tank 44 via a pipe 50 which has a remarkably greater cross-section than the flexible tube 46.

The mixer 52 comprises a substantially cylindrical housing 54 at both sides of which a pair of rollers 56, 58 are rotatably mounted respectively. The rollers 56, 58 run on a rail track 60 which is separated at 62. The lower track section 64 extending up to the gap 62 is mounted on a weighing frame 66 which is supported by a pair of front side load cells 68 and a rear side load cell 70. The three load cells 68,70 form the corners of a triangle and are supported on the undercarriage of wagon 12. The rest of the rail track 60 which is angled and has a slightly sloping end section is directly supported by the undercarriage. A locking bolt 72 secures the weighing frame 66 during transport of the wagon 12.

The mixer housing 54 rests in its lowered position on the lower track section 64 and abuts against stops 74 fastened at the lower ends of the rails of track section 64 which is inclined. The cylinder axis of the housing 54 is parallel with the track section 64 when the housing takes its lowered loading position and forms an angle of approximately 30° with the horizontal plane. The housing can be elevated by a drive unit to be described later and runs upwardly and forwardly along the track 60 and is tilted during this movement so that the housing reaches a forwardly offset elevated discharge position 54' shown with dot and dashes in FIG. 1 in which the cylinder axis of the housing descends slightly in forward direction.

The housing 54 has an upper inlet opening 76 and a front side discharge opening 78. Adjacent to the front wall of the housing 54 a drive motor 80 with a gear box is fastened at the housing and drivingly connected with a mixing shaft (not shown) within the housing 54.

The belt conveyor 36, both worm conveyors 38,40 and the water pipe 50 lead into an upwardly closed hopper 82 to which an upwardly extending dust separator 83 is tightly connected. The hopper has a bottom opening surrounded by descending flexible sheets 85 which form a ring-shaped continuous curtain leading into the inlet opening 76 of the housing with this in its lowered position. The curtain contacts the periphery of the inlet opening 76 and tightly connects the hopper 82 with the housing 54. Therefore the mixing components fall down from the hopper 82 into the housing 54 without any cement dust coming out.

FIGS. 11 and 12 show a drive unit 84 for the reciprocating movement of the mixer 52. A swinging frame 86 mounted for swinging movement about a transverse shaft 88 is arranged near behind a front axle of the wagon 12 supporting the mixer 52. The swinging frame extends rearwardly and upwardly under an angle of approximately 30° onto the housing 54 with the latter in its lowered position and is coupled with the housing 54 in the lower half thereof. The housing 54 is provided with a pair of transversely aligned rotatable rollers 90 which engage slots 92 provided in the swinging frame. The width of the slots 92 is greater than the diameter of the rollers 90. A pivoting arm 94 is fastened with one end on the shaft 88 in the central area thereof. The other end of the pivoting arm 94 is pivotably connected with an hydraulic cylinder 96, the other end of which pivoted at the undercarriage of wagon 12. The connecting line between the ends of the pivoting arm 94 ascends rearwards under an angle of approximately 60°. Upon extension of the hydraulic cylinder 96 the swinging frame 86 is pivoted in a clockwise sense (FIG. 11). Thereby the mixer 52 is moved upwards and forwards on the inclined track section of track 60. The rollers 90 are relatively displaced downwards in the slots 92. When the front-side rollers 58 pass the bend of the track 60 the housing begins to tilt until the elevated discharge position 54' is reached. The longitudinal axis of the housing 54 in this position has a slight slope. The swinging frame 86 has been swung about approximately 90°. After having reached the discharge position the flap of the outlet opening 78 at the front side of the housing is opened and concrete is emptied downwards into a hopper of a concrete pump.

The emptied housing 54 is returned into its lowered position where it abuts against the stops 74 operating as shock absorbers. The hydraulic cylinder 96 is operated to be compressed further by a short distance beyond that position which corresponds to the lowered position of the housing 54. Thereby the swinging frame 86 is swung downwards by a small amount sufficient to loose contact between the rollers 90 and the edges of slots 92 respectively and to form gaps therebetween marked by double arrows in the drawing. Thanks to this lost motion coupling principle the whole drive unit can no longer influence the weighing result of the load cells 68, 70.

With the mixer housing 54 in its lowered position a predetermined amount of water is supplied into the housing via tube 50 and controlled by the load cells and a control system not shown. Then a defined amount of aggregate is supplied via the belt conveyor 36 and additively weighed. Thereafter a cement charge is supplied via the worm conveyor 38 and if necessary powdered mineral is fed by the worm conveyor 40 into the housing 54. All components are weighed additively. Immediately after having loaded the housing 54 the hydraulic cylinder 96 is operated to elevate the housing 54. When the housing 54 has left its lowered position the motor 80 is started to drive the mixer shaft.

Figure 5:
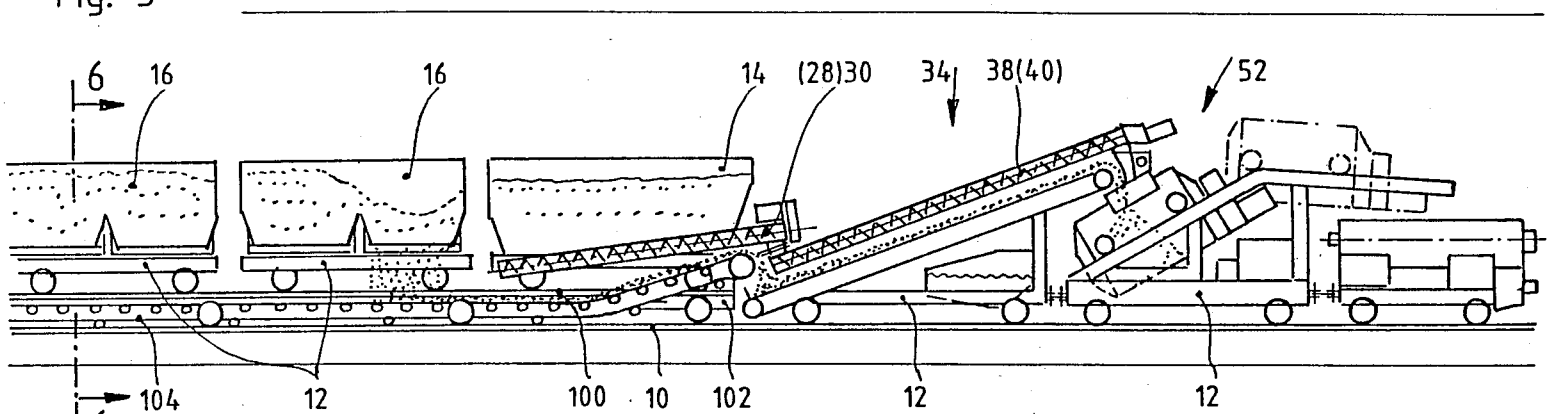
FIG. 5 shows a schematic side view of a modified concreting train.
Figure 5A:
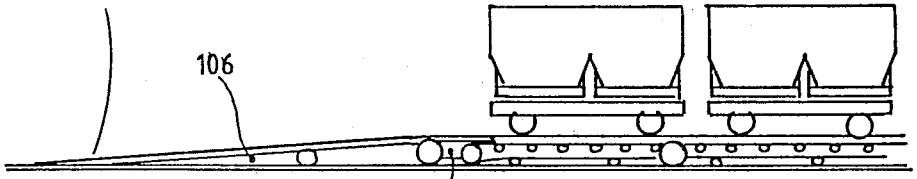
FIG. 5*a* shows the left-sided trailing section of the train according to FIG. 5.
Figure 6:
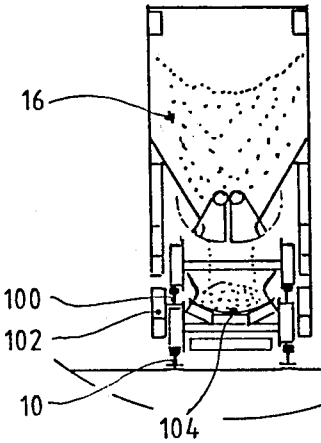
FIG. 6 shows a cross-sectional view taken along line 6—6 of FIG. 5.
Figure 7:
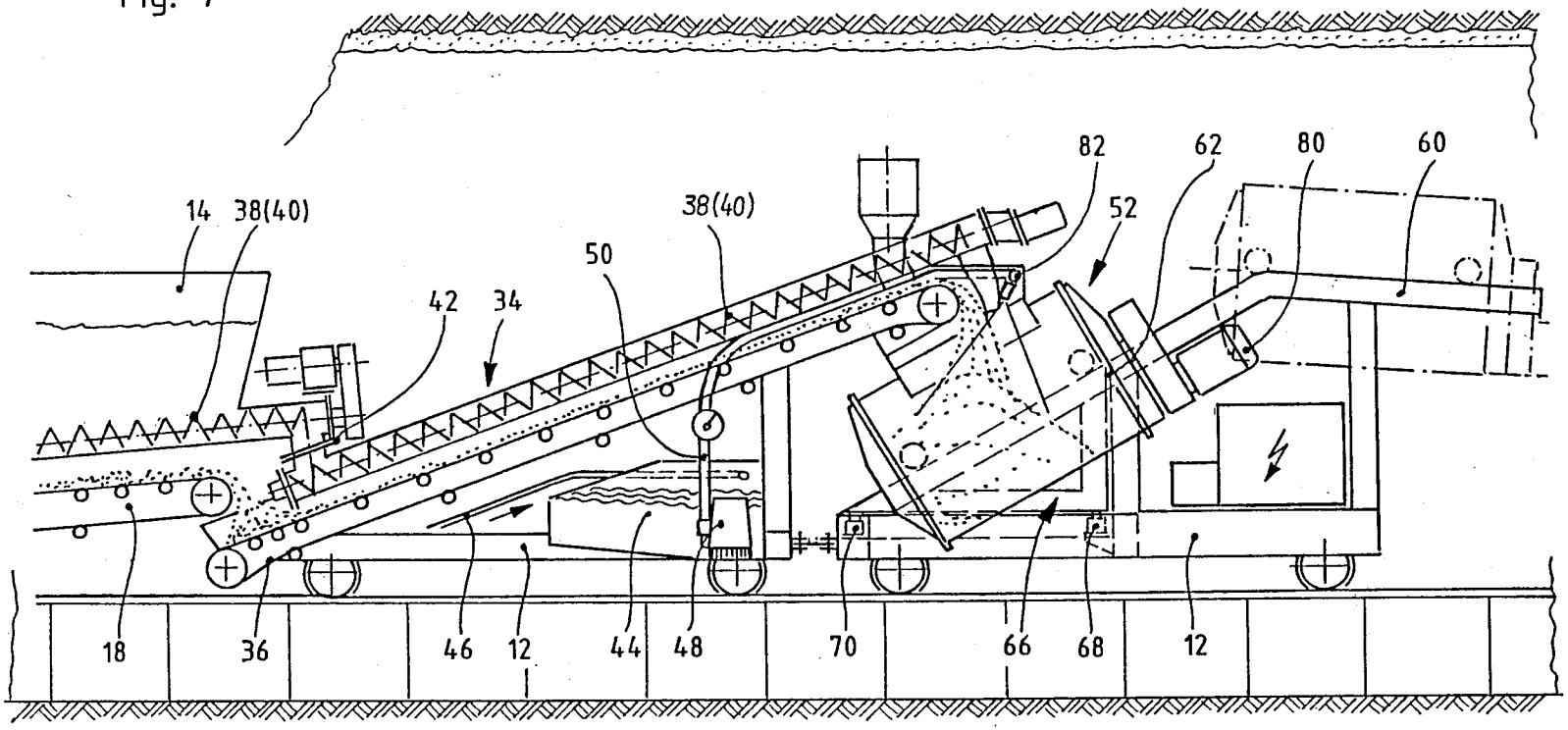
FIG. 7 shows the leading end of the train according to FIG. 1 in greater detail.

FIGS. 5, 5*a* and 6 show a modification of the container wagons 12 which run on a track 100 mounted on a long undercarriage 102 having the same gage as the tunnel rails 10. The undercarriage 102 is provided with an endless conveyor belt 104 extending over the whole length thereof. The conveyor belt 104 extends horizontally below a plurality of containers 16 and is upwardly inclined below the leading container 14 and projects from the wagon 12 thereof. The container wagons 12 no longer need their own conveyor belts but the bottom openings of the containers 16 must have closure flaps as shown in FIG. 6 which one after another are opened beginning with the leading container 16. The multiple conveyor arrangement 34 and the mixer 52 run with their wagons 12 on the tunnel rails. The undercarriage 102 is coupled with the wagon 12 of the multiple conveyor arrangement 34. The concreting train consisting of the two leading wagons 12 and the long undercarriage 102 is continuously moved forward corresponding to growth of the tunnel. The container wagons 14, 16 leave the track 100 of the undercarriage 102 at the trailing end therof via an adjustable ramp 106.

FIG. 13 shows a somewhat modified drive unit 84' for the mixer housing 54. The swinging frame 86, the pivoting arm 94 and the hydraulic cylinder 96 remain unchanged. A pair of drawbars 91 are pivotably connected with the end of the swinging frame 86, extend substantially parallel to the mixing shaft at both sides of the housing 54 respectively, and have broadened ends 93 provided with longitudinally extending slots 95 respectively into which engage cross bolts 97 of the housing 54 respectively. The slots 95 provide that in the lowered position of the housing 54 gaps exist between the cross bolts 97 and the opposite ends of the slots 95 respectively marked by double arrows in FIG. 13. Also in this modification the lost-motion connection provides that the drive unit 84' cannot influence the weighing result.

I claim:

1. A rail mounted concreting train comprising:

a weighing wagon;

a weighing frame on said weighing wagon;

rail track means having a first section supported on said weighing frame and a second section connected to and supported on said weighing wagon, said second section being higher than said first section;

a mixer housing mounted for movement on said rail track means between a weighing position on said first section and a discharge position on said second section, said mixer housing being positioned for receiving aggregate binding agent and water in said weighing position, and for discharging a mixture in said discharge position;

weighing means operatively connected between said weighing frame and said weighing wagon for weighing said weighing frame and said mixer housing with said mixer housing in said weighing position;

mixing means operatively connected to said mixer housing for mixing contents of said mixer housing;

lifting means operatively connected to said mixer housing for lifting said mixer housing from said weighing position to said discharge position;

a leading wagon connected to said weighing wagon;

a binding agent container mounted on said leading wagon for containing a binding agent;

a plurality of trailing wagons connected to said leading wagon;

an aggregate container mounted on each of said trailing wagons; and conveying means extending centrally below said aggregate containers and said binding agent container, and to said mixer housing in said weighing position thereof for conveying aggregate and binding agent to said mixer housing in said weighing position.

2. A concreting train according to claim 1, wherein said first and second sections of said rail track means are separated by a gap, said lifting means being out of contact with said mixer housing, when said mixer housing is in said weighing position, so that the weight measured by said weighing means is free of any influence from said second section of said rail track means and from said lifting means.

3. A concreting train as claimed in claim 1, wherein said binding agent container includes a vertical longitudinal intermediate wall dividing said binding agent container into two separate side-by-side compartments provided with trough-shaped, inclined bottoms respectively, said conveying means including a pair of first conveyor worms, mounted for rotation above said bottoms respectively, discharge ends of the first conveyor worms projecting through a front wall of said binding agent container and wherein a pair of substantially parallel inclined second conveyor worms are operatively associated with the discharge ends of the first conveyor worms.

4. A concreting train as claimed in claim 1, wherein said conveying means includes an endless conveyor belt mounted on and extending the whole length of each one of the trailing and leading wagons, each conveyor belt being arranged below one of the containers, each conveyor belt having an ascending gradient in a direction toward said weighing wagon, each conveyor belt projecting from the front end of one wagon and overlapping the conveyor belt of the next wagon, each aggregate container being provided with at least one permanently open bottom, opening vertically and spaced from the conveyor belt, the bottom opening forming the sole discharge means of the aggregate container.

5. A concreting train as claimed in claim 1, wherein said conveying means comprises an undercarriage for running on rails within a tunnel, said undercarriage being provided with an endless conveyor belt extending over the whole length of the undercarriage and a track mounted on the undercarriage having the same gage as the rails, said leading and trailing wagons being coupled to each other and standing on said track, a vertically movable track ramp provided at one end of the undercarriage, the aggregate containers being provided with bottom discharge openings, vertically spaced from the conveyor belt, and closure means provided for each one of the discharge openings.

6. A concreting train as claimed in claim 1, wherein the bottom of the binding agent container is provided with a pair of side-by-side troughs extending substantially parallel with one another as an ascending gradient in a forward direction toward said weighing wagon, a pair of conveyor worms mounted within said troughs respectively and an endless conveyor belt extending at least over the whole length of the leading wagon below the bottom thereof and spaced therefrom, and having substantially the same ascending gradient as the pair of conveyor worms.

7. A concreting train as claimed in claim 1, including a connecting wagon coupled between the leading wagon and the weighing wagon and provided with multiple conveyor means which comprises a belt conveyor ascending in a forward direction toward the weighing wagon, and at least one worm conveyor extending above the belt conveyor and substantially parallel thereto, upper discharge ends of the both conveyors being positioned above an inlet opening of the mixer housing with the mixer housing in its lowered weighing position.

8. A concreting train as claimed in claim 7, including a supply container adapted to be filled with mixing water and arranged below the multiple conveyor means on said connecting wagon and a water pipe leading from the supply container to an area above the inlet opening of the mixer housing with the mixer housing in its lowered weighing position.

9. A concreting train as claimed in claim 7, including an upwardly closed hopper mounted over the upper discharge ends of both conveyors, a flexible wall extending between the discharge ends of the conveyors and the inlet opening of the mixer housing for confining dust to the hopper, and a dust separator connected to the hopper for removing dust from the hopper.

10. A concreting train as claimed in claim 1, wherein the lifting means comprises a swinging frame mounted for swinging movement about a transverse shaft, arranged near and behind a front axle of the weighing wagon, the swinging frame being swingable rearwardly by an angle in the region between 20° and 45° with the mixer housing in its lowered weighing position and coupled with the housing in a plane below a central axis of the housing and in the elevated discharge position of the mixer housing steeply ascending forwardly, wherein the swinging frame is coupled at the housing by a lost motion drive fastening, a pivoting arm which is shorter than the swinging frame fastened at the transverse shaft and in the lowered weighing position of the housing, ascending rearwardly steeper than the swinging frame, a hydraulic cylinder with one end pivoted at the end of the pivoting arm and the other end of the hydraulic cylinder mounted for swinging movement at the weighing wagon.

11. A concreting train as claimed in claim 1, including riding rollers rotatably mounted to the mixer housing for rolling along the first and second sections of said rail track means, a drive roller connected to the mixer housing, the lifting means comprising a swing frame rotatably mounted to the weighing wagon and having an end engagable with the drive roller and a cylinder operatively connected to the swing frame for pivoting the swing frame to move the mixer housing along the rail track means, the swing frame being out of contact with the drive roller when the mixer housing is in its weighing position.

12. A concreting train as claimed in claim 11, including a drawbar pivotally connected to the swing frame, the drawbar having an elongated slot in one end thereof for receiving the drive roller.

13. A concreting train as claimed in claim 11, including a control system for driving the cylinder to a position for disengaging the swing frame from the drive roller when the mixer housing is in its weighing position.

14. A concreting train as claimed in claim 1, wherein the mixing means includes a mixer shaft which is arranged parallel with the direction of movement of the housing.

15. A concreting train as claimed in claim 1, wherein the mixer housing is of substantially cylindrical shape and one drive motor operatively connected with a mixer shaft is fastened at the outside of a forward end wall of the housing to form the mixing means and a discharge opening of the housing is provided at least near the forward end wall.

* * * * *